United States Patent [19]

McGuire

[11] 4,233,099

[45] Nov. 11, 1980

[54] SLIDE FASTENER METHOD OF MANUFACTURE

[75] Inventor: Ned W. McGuire, Meadville, Pa.

[73] Assignee: Textron Inc., Providence, R.I.

[21] Appl. No.: 971,582

[22] Filed: Dec. 20, 1978

Related U.S. Application Data

[62] Division of Ser. No. 859,671, Dec. 12, 1977, Pat. No. 4,156,303.

[51] Int. Cl.[2] ..... A44B 19/24

[52] U.S. Cl. ..... 156/242; 24/205.11 F; 156/66; 156/219; 156/88; 156/309.6; 156/277; 156/324.4

[58] Field of Search ..... 156/66, 88, 242, 272, 156/277, 306; 24/205.11 R, 205.11 F, 205.16 R, 205.16 D, 205.16 C

[56] References Cited

U.S. PATENT DOCUMENTS

| | | | |
|---|---|---|---|
| 2,438,615 | 3/1948 | Morin | 24/205.11 F |
| 2,582,456 | 1/1952 | Poux | 24/205.16 R |
| 3,490,970 | 1/1970 | Heimberger | 156/66 |
| 3,503,102 | 3/1970 | Ingzawa | 24/205.16 C |
| 3,507,013 | 4/1970 | Ingzawa | 24/205.11 F |
| 3,785,014 | 1/1974 | Canepa | 156/66 |
| 4,023,241 | 5/1977 | Kanzaka | 24/205.11 F |

*Primary Examiner*—Caleb Weston
*Attorney, Agent, or Firm*—O'Brien & Marks

[57] ABSTRACT

A binder seal or reinforcing and finishing strip for the end of a slide fastener is formed by bonding superimposed layers consisting of nylon 6 and a blend of nylon 6 and nylon 6-6 wherein the blend forms an inner layer and the bonding temperature is selected at the melting point of the inner layer but substantially lower than the melting point of the outer film.

5 Claims, 6 Drawing Figures

FIG. 1
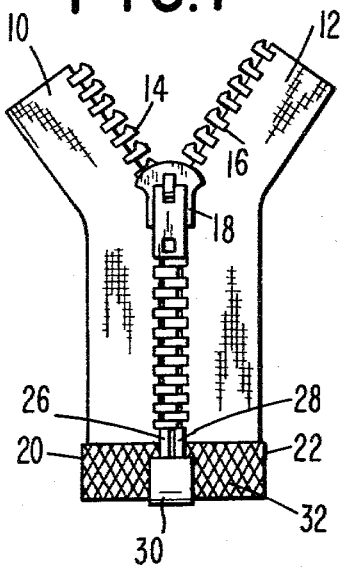
FIG. 2
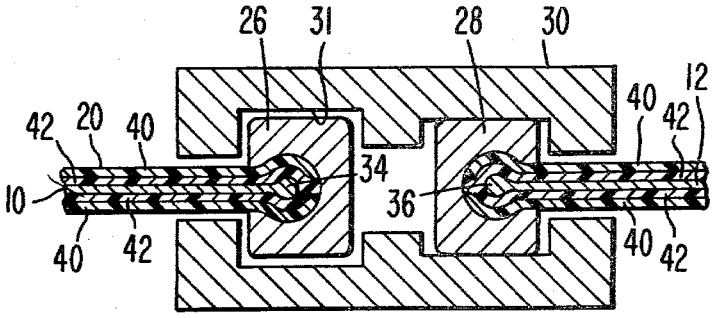
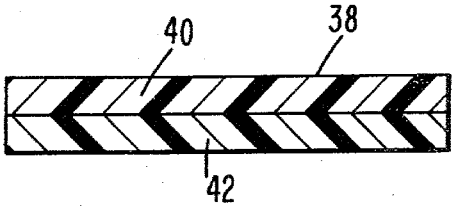
FIG. 3
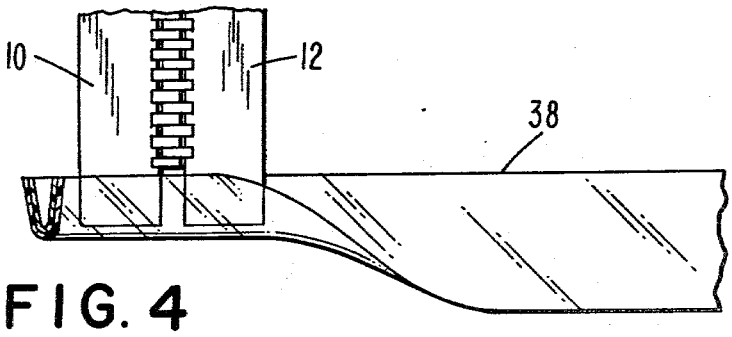
FIG. 4
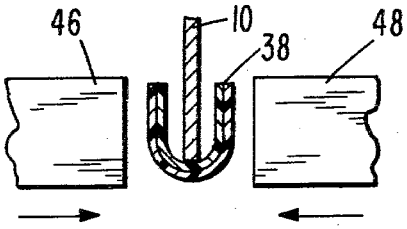
FIG. 5
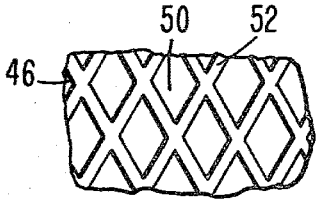
FIG. 6

SLIDE FASTENER METHOD OF MANUFACTURE

CROSS-REFERENCE TO RELATED APPLICATION

This application is a division of parent application Ser. No. 859,671 filed Dec. 12, 1977, now U.S. Pat. No. 4,156,303.

BACKGROUND OF THE INVENTION

1. Field of the Invention

This invention relates to binder seals or reinforcing and finishing strips applied to slide fastener tapes, for example, the bottom ends of separating slide fasteners.

2. Description of the Prior Art

One prior binder seal applied to the bottom ends of separting slide fasteners employs a strip woven from greige nylon filament. The woven strip is dyed to a color closely matching the tapes of the slide fastener. A solvent-base adhesive is applied to one side of the dyed strip by means of a doctor blade. Subsequently the strip is folded longitudinally with the adhesive inside and the bottom ends of the slide fastener tapes are inserted within the fold of the strip. While the adhesive is softened by solvent, the folded halves of the strip are bonded by pressure to the opposite sides of the bottom ends of the slide fastener tapes. The bonded strip is then trimmed. This prior art process, besides requiring the steps of weaving and dyeing as well as the relatively difficult step of applying the adhesive by a doctor blade to the woven tape, also requires drying steps to permit the solvent to evaporate. Also inventories of various colored strips must be maintained so that the ends of slide fasteners may be bound without undue delay after manufacture.

U.S. Pat. No. 2,438,615, No. 2,582,456, No. 3,503,102 No. 3,507,013 and No. 4,023,241 disclose slide fasteners with reinforcing strips bonded on the end or other portions of the tapes or stringers. Although the prior art contains the suggestion such as in the above U.S. Pat. No. 3,503,102 for utilizing a plastic film folded around the marginal edges of the tapes of a slide fastener, a reliable and adequate plastic film replacement for the woven tape and solvent adhesive has previously not been found. In the above U.S. Pat. No. 2,582,456 it is described that the amount of heat and pressure applied is important for reason that the plastic material should not be heated to its melting temperature, but merely sufficient to force the strip material into the interstices in the outer surface of the tape so that the strip lies substantially in the plane thereof and so that the tape end has substantially the same thickness as the remainder of the tape. However such prior art plastic strip materials applied by heat and pressure in the prior art were deficient in that the bonds between the strip and the slide fastener tapes were subject to failure during laundry, and often resulted in extruded plastic on the sides of the tape rendering subsequent handling and trimming steps more difficult.

SUMMARY OF THE INVENTION

The invention is summarized in a method of forming a reinforcing and finishing strip on the ends of textile tapes of a slide fastener wherein reinforcing and finishing strip portions having an outer film of nylon 6 and inner layer of a blend of nylon 6 and nylon 6-6 are bonded to end portions of the textile tapes by engaging the outer film with a heated tool having a temperature in the melting temperature range of the inner layer but substantially below the melting temperature of the outer film so that the inner layer is molded into interstices of the tape end portions in intimate contact with substantial surface portions of the fibers of the tape while the outer film remains coherent and generally uniform in thickness.

An object of the invention is to construct a slide fastener with a binder seal or reinforcing and finishing strip which is substantially less expensive and saves production steps and cost.

Another object of the invention is to construct different color slide fasteners utilizing a single reinforcing strip for the different color fasteners.

It is also an object of the invention to eliminate the requirement for large inventories of different color binder seal or reinforcing strips for slide fasteners.

It is a further object of the invention to eliminate dyeing steps for reinforcing strips for slide fasteners.

A still further object of the invention is to eliminate difficult and unreliable steps for applying adhesives to reinforcing strips for slide fasteners.

Yet another object of the invention is to increase operator productivity in the manufacture of slide fasteners.

A still further object of the invention is to provide for increased tool life in the manufacture of slide fasteners.

An advantage of the invention is that clear thermoplastic materials permit the color of the tapes to show through and thus are unobtrusive.

Another feature of the invention is the employment of a thermoplastic layer of lower melting temperature formed around and in contact with substantial fiber portions at the surface of a tape to form a firm bond with the tape together with an outer thermoplastic layer of higher melting temperature maintaining its thickness and stability to provide reinforcement An additional feature of the invention is the employment of one thermoplastic material in the outer film together with the employment of a lower melting blend of the same thermoplastic material with another thermoplastic material to thus form a compatible outer tape and adhesive inner film.

A further feature of the invention includes the employment of nylon 6 in an outer cohesive film together with the employment of a lower melting blend of nylon 6 and nylon 6—6 as an inner adhesive layer.

A still further feature of the invention includes the provision of embossing a film reinforcing strip to more closely match the appearance of a fabric tape of a slide fastener as well as to provide for easier gripping of the slide fastener tape ends.

Other objects, advantages and features of the invention will be apparent from the following description of the preferred embodiment taken in conjunction with the accompanying drawings.

BRIEF DESCRIPTION OF THE DRAWINGS

FIG. 1 is a plan view of a separable slide fastener constructed in accordance with the invention.

FIG. 2 is an enlarged cross section view of a broken away portion of the bottom end of the slide fastener of FIG. 1.

FIG. 3 is a still further enlarged view of a portion of a strip for forming a binder seal for the slide fastener of FIG. 1.

FIG. 4 is a plan view of a binder strip and bottom end of a slide fastener during a step of the application of the binder strip to the slide fastener tape.

FIG. 5 is a side view of the binder strip and slide fastener bottom end shown in FIG. 4.

FIG. 6 is an enlarged plan view of a portion of the face of a tool for bonding the reinforcing strip to the slide fastener tape.

DESCRIPTION OF THE PREFERRED EMBODIMENT

As shown in FIG. 1, a separable slide fastener manufactured in accordance with the invention includes textile carrier means, such as woven tapes 10 and 12 with respective rows of coupling elements 14 and 16 attached to the inner edges thereof. The tapes 10 and 12 are dyed or colored. A slider 18 is slidably mounted on the coupling elements 14 and 16 opening and closing the slide fastener. The bottom ends of the tapes 10 and 12 are covered with respective clear binder seals or reinforcing and finishing strip sections 20 and 22. Also at the bottom end of the slide fastener, the coupling elements 14 and 16 are replaced by pin members 26 and 28 crimped over beaded inner edges 34 and 36, FIG. 2, of the tapes 10 and 12. A box member or retainer 30 is secured on the pin member 28 such as by crimping and has a channel 31, FIG. 2, for releasably receiving the pin member 26.

The reinforcing strip sections 20 and 22 are formed from a flexible strip 38 which, as shown in FIGS. 2 and 3, includes an outer film or layer 40 and an inner film or layer 42. The layers 40 and 42 are different but compatible clear thermoplastic materials. The material of the inner layer 42 has a lower melting point than the film 40 and is selected to form a firm bond both with the outer film 40 and the textile tapes 10 and 12 suitable to withstand laundry. The bond to the tapes 10 and 12 is made strong by the layer 42 being molded into the interstices of the fabric in the front and back surfaces of the tapes 10 and 12 in intimate contact with substantial surface portions of the fibers at the surfaces of the tapes. Also the inner layer 42 bonds the fibers at the lower ends of the tapes 10 and 12 together to prevent fraying. The outer film 40 is coherent and has a generally uniform thickness. The material of the film 40 is selected with the layer 42 so as to stiffen the ends of the tapes 10 and 12 but to remain flexible. A preferred material for the outer layer 40 is clear nylon 6 and a preferred material for the inner layer 42 is a clear blend of nylon 6 and nylon 6—6 containing from 25% to 30% by weight of the nylon 6—6. Typically the outer film 40 is about 0.0762 millimeters (3 mils) thick while the inner layer 42 initially has about the same thickness. One suitable material for forming the inner layer 42 is heat-sealable film-like adhesive available under the trademark FUS-O-BOND by General Fabric Fusing, Inc., 5543 Colerain Ave., Cincinnati, Ohio, USA; this material has been analyzed as consisting of (1) aminocaproic acid hydrochloride, (2) 2-oxohexamethylene imine, (3) hexamethylene diamine dihydrochloride, and (4) adipic acid, components (3) and (4) being 25 to 30% by weight of the material. Clear thermoplastic materials other than nylon 6 and the blend of nylon 6 and nylon 6—6 may be used but these materials must be compatible in that they must strongly bond with each other and with the tapes 10 and 12 and must withstand laundry. Some materials have been found not to be compatible; polyester and polyethylene films loosen and peel off during laundry when bonded with a heat-sealing adhesive of nylon 6 and nylon 6—6.

The reinforcing strip sections 20 and 22 have patterns of ridges 32 formed on the surfaces thereof on both the front and back of the tapes 10 and 12. The ridge patterns are designed, such as the illustrated criss crossing pattern of straight diagonal ridges, to reduce or interrupt the shiny surface of the strips 20 and 22, to produce the appearance of the weaving pattern of the tapes 10 and 12, and to provide gripping surfaces for being more readily gripped by the fingers of a person closing the slide fastener.

In manufacture of the slide fastener of FIG. 1, initially the tapes 10 and 12 are woven, the tapes are dyed to a selected color, the coupling elements 14 and 16 are attached to the inner edges of the respective tapes 10 and 12 and the slider 18 is assembled on the coupling elements 14 and 16 in a conventional manner. The inner film 42 of adhesive is laminated to the outer film 40 by heat and pressure to form the composite strip 38 of FIG. 3 such as by heated rollers. This strip 38, for example about 1.905 centimeters (0.75 inches) wide, is folded longitudinally as shown in FIGS. 4 and 5 with the inner layer 42 of adhesive inside. The lower ends of the slide fastener tapes 10 and 12 are positioned between the folded halves or portions of the strip 38. Tools 46 and 48, heated to about the melting temperature of the inner layer 42, are brought against the front and back sides of the folded strip 38 to firmly secure and bond the strip 38 to the lower ends of the textile tapes 10 and 12. For the blend of 70–75% nylon 6 and 25–30% nylon 6—6, the tools 46 and 48 are heated to a temperature in a preferred range of temperatures from 148°–163° C. (300°–325° F.) or especially preferred temperature of 157° C. (315° F.). During the bonding, the inner layer 42 is heated to a plasticized state where the material flows into interstices and around the fibers in the front and back surfaces of the textile tapes 10 and 12. The outer film 40 is not melted and remains coherent and substantially the same thickness during the attachment of the strip 38 to the bottom ends of the tapes 10 and 12. The strip 38 is cut and trimmed either during or after the bonding to leave the bonded strip sections 20 and 22 on the bottom ends of the tapes 10 and 12; conveniently the tools 46 and 48 may be provided with conventional cutting edges for performing the cutting and trimming step simultaneously with the bonding.

Additionally as shown in FIG. 6 the faces of the tools 46 and 48 are formed with protrusions such as raised diamond-shaped portions 50 leaving a grid-like pattern of channels 52. The protrusions 50 result in the embossing of the ridge pattern 32 in the outer surface of the strip portions 20 and 22; however due to the higher melting temperature of the outer film 40, for example 204°–216° C. (400°–420° F.) for nylon 6, the outer film 40 remains coherent and substantially uniform in thickness. Also the protrusions aid in driving the adhesive 42 into the tapes 10 and 12.

After forming of the bonded strip portions 20 and 22, the pin members 26 and 28 are attached on the inner beaded edges of the tapes 10 and 12, and the retainer 30 is attached to the pin member 28 in a conventional manner.

The clear thermoplastic reinforcing strip sections 20 and 22 permit colored tapes 10 and 12 to be visible through the sections 20 and 22; thus the reinforcing sections 20 and 22 do not change the color or detract from the color of the tapes 10 and 12. This use of clear reinforcing strips 20 and 22 eliminates the prior art requirement for reinforcing strips to be colored to match the color of the tapes; thus prior art dyeing steps for the prior art woven reinforcing strips as well as inventories of dyes or coloring materials for the strips are eliminated. Also inventories of different colored strips required to avoid delays in the prior art manufacture of different colors of slide fasteners are no longer necessary; only one strip, i.e., the clear strip 38, is maintained in inventory. The present invention eliminates the prior art weaving steps for the prior art woven reinforcing strips.

A substantial reduction in cost is made by substituting the heat-sealed strip portions 20 and 22 for the prior art woven strips and solvent-based adhesive. Operator productivity and tool life are both increased. The materials are less expensive.

The film-like heat-sealable thermoplastic adhesive 42 is substantially easier to apply to the outer film 40 than the prior art solvent-based adhesive applied by a doctor blade to the woven strip of the prior art. Also, the prior art requirement for drying the solvent-based adhesive is eliminated.

The substantial reinforcement or stiffening which was best provided in the prior art by a woven strip is provided now in the present invention by the coherent outer film 40 in combination with the adhesive layer 42. Prior art heat sealed thermoplastics molded into or onto the tapes could not be controlled easily and were difficult to apply to the tapes. The present use of a two layered strip where the outer layer has a relatively high melting temperature avoids extrusion of the thermoplastic material on the edges and permits release of the sealing tools without cooling or other steps to avoid adherence of the thermoplastic to the tools.

The ridge pattern 32 formed on the outer surfaces of the reinforcing sections 20 and 22 results in the disruption or breaking up of the shiny surface of the polymer film in a simulation of the fiber surfaces of the textile tapes 10 and 12. Also the ridge patterns 32 improved the ability of the ends of the tapes 10 and 12 to be gripped by a user in inserting the pin member 26 into the retainer 30 when securing the halves of the slide fastener together.

Although the above described reinforcing strip sections 20 and 22 were designed primarily for the bottom ends of separable type slide fasteners, this reinforcing strip means may be applied to other portions or upper ends of slide fastener tapes and to different types of slide fasteners other than the separating type of slide fastener.

Since many modifications, variations and changes in detail may be made to the present invention, it is intended that all matter described in the foregoing description and shown in the accompanying drawings be interpreted as illustrative and not in a limiting sense.

What is claimed is:

1. A method of forming a reinforcing and finishing strip on the ends of textile tapes of a slide fastener comprising the steps of superimposing reinforcing and finishing strip portions on at least one of the front and back sides of end portions of the tapes, the strip portions having an inner layer facing the textile tapes and an outer film laminated to the inner layer, the outer film consisting of a nylon 6 having a melting temperature substantially greater than 163° C., and the inner layer consisting of a blend of a nylon 6 and nylon 6—6 having a melting temperature within the range from 148° to 163° C., engaging the outer film of the strip portions with a heated tool having a temperature within the range from 148° to 163° to heat the strip portion to the melting temperature of the inner layer but below the melting temperature of the outer film, and pressing the strip portions by means of the tool onto the end portions of the tapes so that the inner layer is molded into interstices of the tape end portions and in intimate contact with substantial surface portions of the fibers of the tape end portions to securely bond the strip portions to the at least one side of the end portions of the tape with the outer film remaining coherent and generally uniform in thickness.

2. A method as claimed in claim 1 wherein the outer film and the inner layer are both clear, and the amount of nylon 6—6 is in the range from 25 to 30% by weight of the blend of nylon 6 and nylon 6—6.

3. A method as claimed in claim 1 wherein the superimposing step includes superimposing front and back strip portions on the respective front and back sides of the ends of the tapes, and the inner layers of the front and back strip portions are molded and bonded to the front and back sides of the ends of the tapes.

4. A method as defined in claim 1 including the step of embossing the outer surface of the reinforcing strip to form a pattern of ridges on the reinforcing strip.

5. A method as claimed in claim 4 wherein the embossing includes the engaging of the strip portions with a heated tool having raised projections leaving a pattern of channels for forming the ridges on the reinforcing strip.

* * * * *